US005138911A

United States Patent [19]

Lan

[11] Patent Number: 5,138,911

[45] Date of Patent: Aug. 18, 1992

[54] TELESCOPIC WRENCH EXTENSIONER

[76] Inventor: Wen-Rong Lan, 4th Fl., No. 4, Alley 9, Lane 145, Sec. 4, Hsing-Lung Rd., Taipei City, Taiwan

[21] Appl. No.: 772,742

[22] Filed: Oct. 7, 1991

[51] Int. Cl.[5] ..... B25G 1/04

[52] U.S. Cl. ..... 81/177.2; 403/108; 403/328

[58] Field of Search ..... 81/177.2; 403/108, 328, 403/325

[56] References Cited

U.S. PATENT DOCUMENTS 1,491,077 4/1924 Beerworth ..... 403/108 X
3,712,652 1/1973 Uilkema ..... 403/108
4,367,663 1/1983 Merics ..... 81/177.2
4,905,548 3/1990 Colace et al. ..... 81/177.2

*Primary Examiner*—D. S. Meislin
*Attorney, Agent, or Firm*—Lowe, Price, LeBlanc & Becker

[57] ABSTRACT

A telescopic wrench extensioner includes a tubular member with a closed end portion that has a polygonal axial recess which is adapted to engage a socket wrench, and a shaft member having a first end slidably extending into the tubular member and a second end extending out of the tubular member and being provided with an axial socket operating portion that is polygonal in cross section and that is adapted to engage a wrench socket. The shaft member can be maintained at a selected position relative to the tubular member.

2 Claims, 4 Drawing Sheets

TELESCOPIC WRENCH EXTENSIONER

BACKGROUND OF THE INVENTION

1. Field of the Invention

The invention relates to a wrench extensioner, more particularly to a telescopic wrench extensioner.

2. Description of the Related Art

Although the standard of living has considerably increased these past few decades, the acquisition of basic manual skills, such as carpentry, has also been made easier. Thus, there are some people who prefer to rely on their own skill and expertise rather than calling upon the services of a skilled laborer. The "Do It Yourself" concept is therefore born from people with this kind of attitude. In the "Do It Yourself" concept, the consumer purchases a half-finished product and completes the product by himself. The purchasing cost incurred is lower, and the consumer can amuse himself while assembling the product.

The "Do It Yourself" concept has also become very popular in the field of automobile repair. Present automobile constructions are generally smaller. The size of the engine compartment is thus reduced. This makes it difficult for one to tinker with the different parts of the automobile engine.

Conventional socket wrenches include a lever arm having one end which engages a wrench socket so as to hold or turn a bolt, nut, etc. In order for one to loosen or tighten nuts (or bolts) disposed in "hard-to-reach" places or in cramped places wherein the lever operating space is limited, a wrench extensioner must be used. The wrench extensioner is basically an elongated shaft member, one end of which engages the lever arm while the other end engages the socket wrench. If different lengths of wrench extensioners were purchased, the required tool space is increased and the costs incurred are correspondingly increased.

SUMMARY OF THE INVENTION

Therefore, the objective of the present invention is to provide a telescopic wrench extensioner to replace the conventional different lengths of wrench extensioners.

More specifically, the main objective of the present invention is to provide a telescopic wrench extensioner, the length of which can be easily adjusted.

Another objective of the present invention is to provide a telescopic wrench extensioner that can be conveniently stored and carried.

Accordingly, the preferred embodiment of a telescopic wrench extensioner of the present invention comprises a tubular member having an open end, an opposite closed end portion provided with an axial recess that is adapted to engage a socket wrench, an axially extending slot disposed between the open end and the closed end portion, and a plurality of spaced engaging holes provided along the axially extending slot. A shaft member has a first end slidably extending into the tubular member and a second end extending out of the tubular member and being provided with an axial socket operating portion that is adapted to engage a wrench socket. The shaft member further has a receiving groove that is aligned with the axially extending slot of the tubular member and disposed adjacent to the first end thereof. The receiving groove has a first and a second upright end portion and a lateral portion communicating outermost sections of the first and second upright end portions. A releasable engaging means is disposed in the receiving groove and extends into the axially extending slot to releasably engage a selected one of the engaging holes and maintain the shaft member at a selected position relative to the tubular member. The releasable engaging means includes a compression spring received in the first upright end portion of the receiving groove, and a press member having an upright pivot shaft portion movably extending into the second upright end portion of the receiving groove and having a lower end pivoted to the shaft member at an innermost section of the second upright end portion, an elongated connecting portion extending transversely from an upper section of the pivot shaft portion and being aligned with the lateral portion of the receiving groove, an upward press projection extending from a top side of the connecting portion and outward of the axially extending slot, and a pair of aligned engaging projections respectively provided on opposite sides of the connecting portion adjacent to a distal end of the connecting portion. The engaging projections are biased by the compression spring to extend normally into the selected engaging hole so as to engage the tubular member and the shaft member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
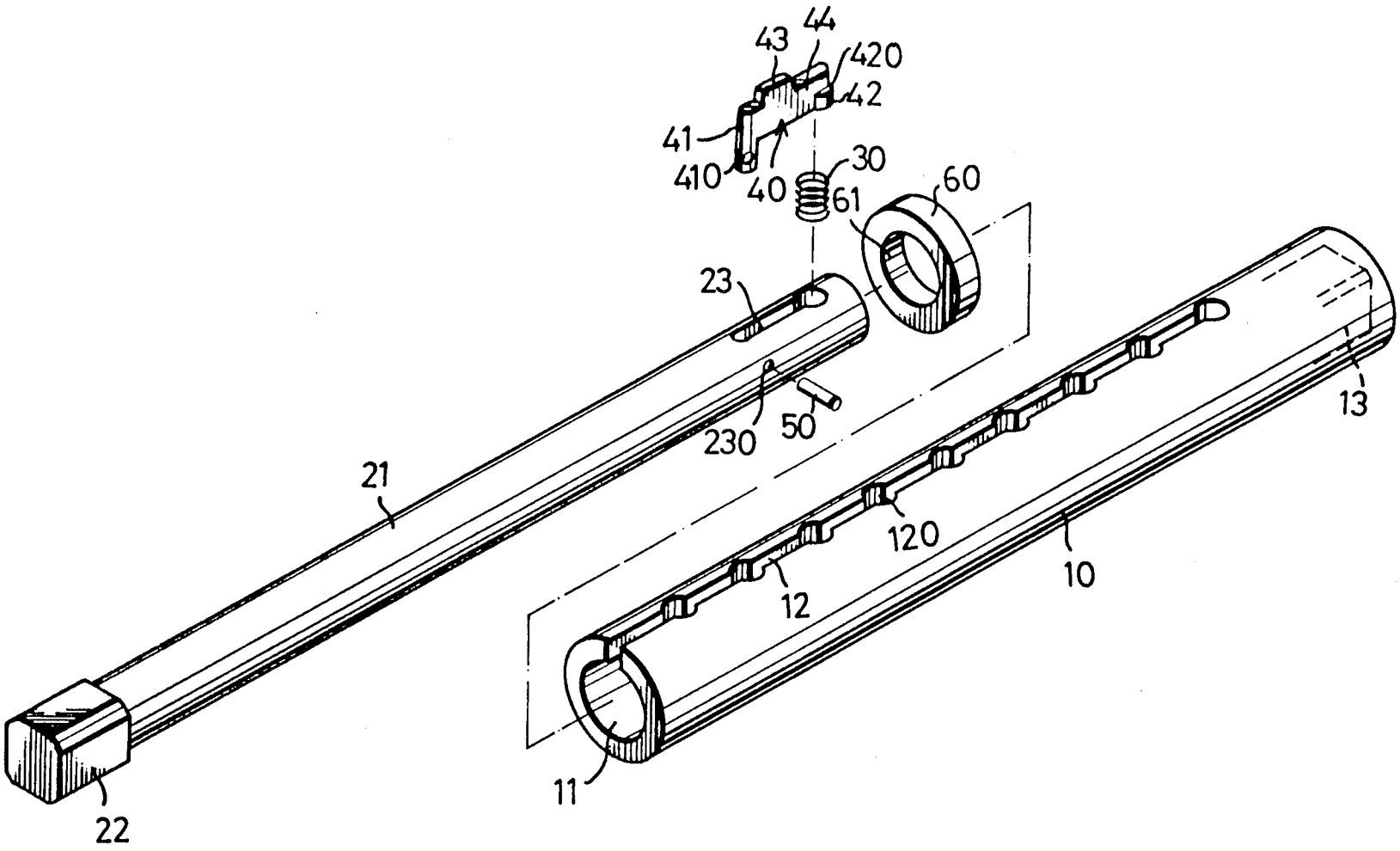
FIG. 1 is an exploded view of the telescopic wrench extensioner of the present invention.

Referring to FIG. 1, the preferred embodiment of a telescopic wrench extensioner according to the present invention is shown to comprise a tubular member (10), a shaft member (20), a compression spring (30), a press member (40), a fastening pin (50) and a ring member (60).

The tubular member (10) has an open end (11) and an axially extending slot (12) extending from the open end (11) up to a predetermined length of the tubular member (10). A plurality of spaced engaging holes (120) is provided on the tubular member (10) along the slot (12). The tubular member (10) further has a closed end portion formed with a rectangular axial recess (13).

Figure 2A:
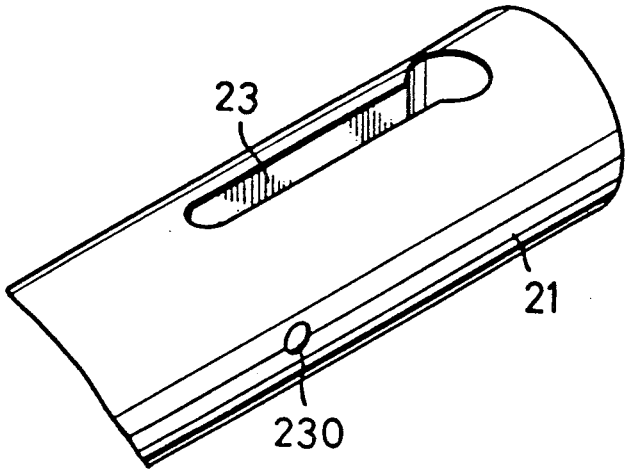
FIG. 2A is a perspective view of the rear end of a shaft member of the telescopic wrench extensioner shown in FIG. 1.
Figure 2B:
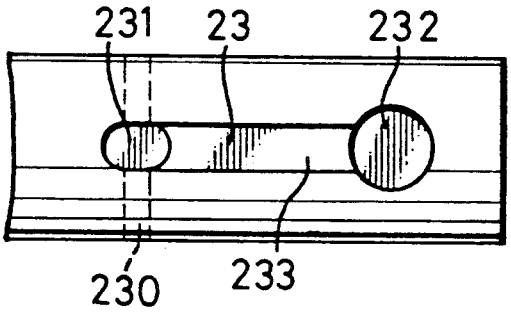
FIG. 2B is a top view of the rear end of the shaft member shown in FIG. 2A.
Figure 2C:
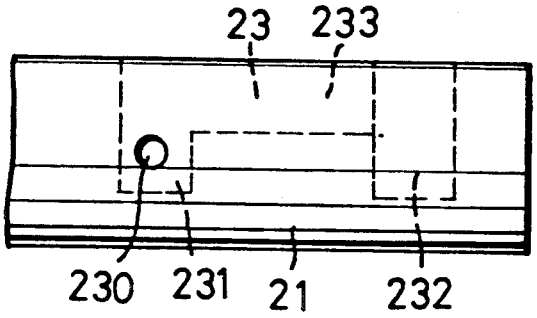
FIG. 2C is a side view of the rear end of the shaft member shown in FIG. 2A.

Referring to FIG. 1 and to FIGS. 2A through 2C, the shaft member (20) has a shaft portion (21), one end of which is provided with an axially extending rectangular socket operating portion (22). A receiving groove (23)

is formed on the shaft portion (21) adjacent to the other end of the same. The receiving groove (23) has two upright end portions, (231) and (232), and a lateral portion (233) communicating the outermost sections of the upright end portions, (231) and (232). The compression spring (30) is received in the upright end portion (232) of the receiving groove (23). The shaft portion (21) is further formed with a through hole (230) passing through the innermost section of the upright end portion (231). The shaft portion (21) is inserted into the tubular member (10) via the open end (11) of the latter.

Figure 3A:
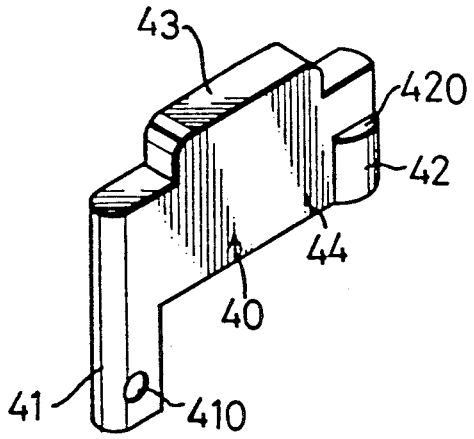
FIG. 3A is a perspective view of a press member of the telescopic wrench extensioner shown in FIG. 1.
Figure 3B:
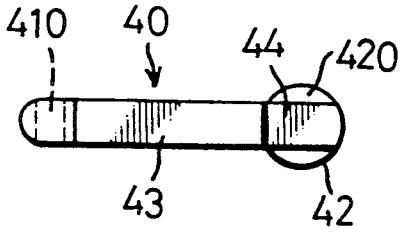
FIG. 3B is a top view of the press member shown in FIG. 3A.
Figure 3C:
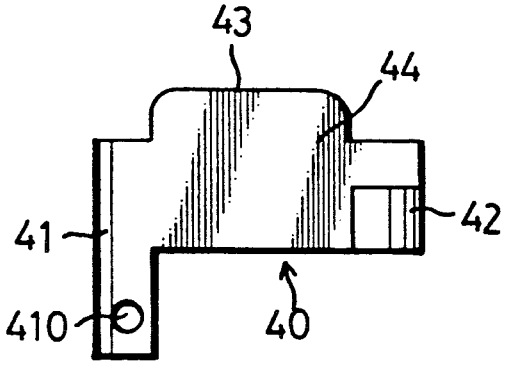
FIG. 3C is a side view of the press member shown in FIG. 3A.

The press member (40) joins the tubular member (10) and the shaft member (20). Referring to FIG. 1 and to FIGS. 3A through 3C, the press member (40) has an upright pivot shaft portion (41) movably received in the upright end portion (231) of the receiving groove (23). The pivot shaft portion (41) has a through hole (410) aligned with the through hole (230) of the shaft member (20). The fastening pin (50) extends through the through holes, (230) and (410), to mount the press member (40) to the shaft member (20). The press member (40) is thus pivotable about the fastening pin (50). The press member (40) further has an elongated connecting portion (44) extending transversely from an upper section of the pivot shaft portion (41). The connecting portion (44) has two opposite sides each being provided with an engaging projection (42) disposed adjacent to a distal end of the connecting portion (44). The projections (42) are biased by the compression spring (30) to normally extend into a selected one of the engaging holes (120) to thereby engage the tubular member (10) and the shaft member (20). The top side of the connecting portion (44) is further provided with an upward press projection (43) that extends outwardly of the axial slot (12) so as to facilitate the application of a pressing force thereto.

Assembly of the telescopic wrench extensioner is as follows: the shaft portion (21) of the shaft member (20) extends into the opening (61) defined by the ring member (60). The compression spring (30) is placed in the upright end portion (232) of the receiving groove (23). The press member (40) is then provided in the receiving groove (23). The respective bottom surfaces of the projections (42) are in contact with the compression spring (30). After aligning the through holes, (230) and (410), the fastening pin (50) is inserted therein to pivotably mount the press member (40) to the shaft member (20).

A pressing force is then applied on the press portion (43) as the shaft member (20) is inserted into the tubular member (10) at the open end (11) of the latter. When the pressing force is released, the compression spring (30) expands, and the projections (42) engage a selected one of the engaging holes (120) on the tubular member (10) to prevent further sliding movement of the shaft member (20) relative to the tubular member (10). The ring member (60) is then welded onto the open end (11) of the tubular member (10) to prevent the detachment of the shaft member (20) from the tubular member (10).

Figure 4:
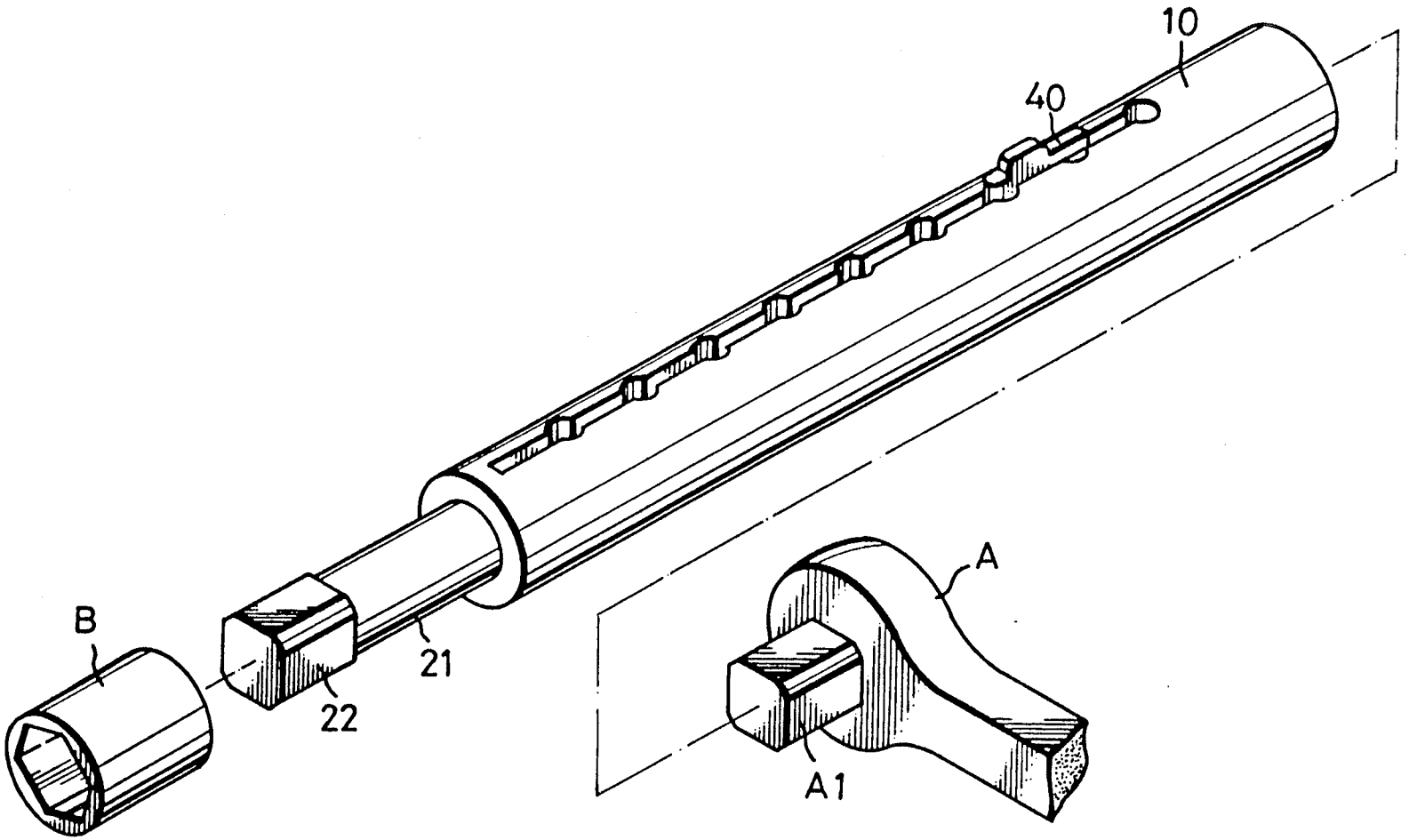
FIG. 4 is an illustration of the assembled preferred embodiment of a telescopic wrench extensioner according to the present invention.

FIG. 4 is an illustration of the preferred embodiment when used with a socket wrench. The socket wrench has a lever arm (A), one end of which is provided with a transverse rectangular operating shaft (A1) that extends into the recess (13) of the tubular member (10). The socket operating portion (22) of the shaft member (20) extends into one end of a wrench socket (B). To vary the distance between the operating shaft (A1) and the wrench socket (B), a pressing force is applied on the press portion (43) so as to compress the spring (30) and disengage the projections (42) from the engaging holes (120) of the tubular member (10). The shaft member (20) is then slidably adjusted relative to the tubular member (10). After the shaft member (20) has been adjusted to the desired position, the press member (40) is released, thereby causing the compression spring (30) to expand, and the projections (42) to engage the selected one of the engaging holes (120). Further sliding movement of the shaft member (20) is thus prevented to therefore maintain the shaft member (20) in the desired position. The socket wrench and the wrench socket (B) are conventional in construction and will not be detailed further. The preferred embodiment permits one to loosen or tighten nuts (or bolts) disposed in "hard-to-reach" places or in cramped places.

The length and thickness of the press member (40) may be designed so as to increase its resistance to the shearing force present between the tubular member (10) and the shaft member (20) when the preferred embodiment is in use.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A telescopic wrench extensioner, comprising:

a tubular member having an open end, an opposite closed end portion provided with a polygonal axial recess, an axially extending slot disposed between said open end and said closed end portion, and a plurality of spaced engaging holes provided along said axially extending slot;

a shaft member having a first end slidably extending into said tubular member and a second end extending out of said tubular member and being provided with an axial socket operating portion that is polygonal in cross section, said shaft member having a receiving groove that is aligned with said axially extending slot of said tubular member and disposed adjacent to said first end; and a releasable engaging means disposed in said receiving groove and extending into said axially extending slot to releasably engage a selected one of said engaging holes and maintain said shaft member at a selected position relative to said tubular member.

2. The telescopic wrench extensioner as claimed in claim 1, wherein:

said receiving groove has a first and a second upright end portion and a lateral portion communicating outermost sections of said first and second upright end portions;

said releasable engaging means including a compression spring received in said first upright end portion of said receiving groove, and a press member having an upright pivot shaft portion movably extending into said second upright end portion of said receiving groove and having a lower end pivoted to said shaft member at an innermost section of said second upright end portion, an elongated connecting portion extending transversely from an upper section of said pivot shaft portion and being aligned with said lateral portion of said receiving groove, an upward press projection extending from a top side of said connecting portion and outward of said axially extending slot, and a pair of aligned engaging projections respectively provided on opposite sides of said connecting portion adjacent to a distal end of said connecting portion, said engaging projections being biased by said compression spring to normally extend into the selected one of said engaging holes to engage said tubular member and said shaft member.

* * * * *